US011641896B2

(12) United States Patent
Ripley et al.

(10) Patent No.: US 11,641,896 B2
(45) Date of Patent: May 9, 2023

(54) MITTEN PACIFIER

(71) Applicants: Jordan Ripley, Carlisle, IA (US); Nicholas Ripley, Carlisle, IA (US)

(72) Inventors: Jordan Ripley, Carlisle, IA (US); Nicholas Ripley, Carlisle, IA (US)

( * ) Notice: Subject to any disclaimer, the term of this patent is extended or adjusted under 35 U.S.C. 154(b) by 189 days.

(21) Appl. No.: 16/752,233

(22) Filed: Jan. 24, 2020

(65) Prior Publication Data

US 2020/0237036 A1 Jul. 30, 2020

Related U.S. Application Data

(60) Provisional application No. 62/797,991, filed on Jan. 29, 2019.

(51) Int. Cl.

| | |
|---|---|
| ***A61J 17/00*** | (2006.01) |
| ***A41D 19/01*** | (2006.01) |
| ***A41D 19/00*** | (2006.01) |

(52) U.S. Cl.

CPC ..... *A41D 19/0024* (2013.01); *A41D 19/0037* (2013.01); *A41D 19/01* (2013.01); *A61J 17/001* (2015.05)

(58) Field of Classification Search

CPC ..... A41D 19/0003; A41D 19/0024; A41D 19/0041; A41D 19/0037; A41D 19/01; A41D 19/01594; A61J 17/00; A61J 17/001

See application file for complete search history.

(56) References Cited

U.S. PATENT DOCUMENTS

| | | | |
|---|---|---|---|
| 2,798,482 | A | 7/1957 | Feeney |
| 2,902,693 | A | 9/1959 | Wells, Jr. |
| 5,385,573 | A | 1/1995 | Wright |
| 5,391,184 | A | 2/1995 | Rosenthal |
| 6,500,196 | B2 | 12/2002 | Shattles |
| 6,634,919 | B2 | 10/2003 | Gordon et al. |
| 9,560,888 | B2 | 2/2017 | Kiraly |
| 10,058,486 | B2 | 8/2018 | Steward |
| 2005/0222621 | A1 | 10/2005 | Duwelius et al. |
| 2007/0288056 | A1 | 12/2007 | Goldwire |
| 2009/0163952 | A1 | 6/2009 | Kash |
| 2012/0016416 | A1 | 1/2012 | Frazier |
| 2018/0055741 | A1 | 3/2018 | Hyslop |

FOREIGN PATENT DOCUMENTS

| | | | |
|---|---|---|---|
| CN | 206239752 | U | 6/2017 |
| DE | 202009016433 | U1 | 4/2010 |
| EP | 2815658 | A1 | 12/2014 |
| GB | 2417426 | A | 3/2006 |

*Primary Examiner* — Sally Haden

(74) *Attorney, Agent, or Firm* — McKee, Voorhees & Sease, PLC

(57) ABSTRACT

A pacifier includes a nipple mounted on a mitten, which fits on either the left or right hand of a baby. The nipple extends laterally outwardly from one side edge of the mitten, in a region adjacent the baby's thumb. A strap on the mitten can be tightened to prevent the baby from losing the pacifier when the pacifier is not in the baby's mouth.

17 Claims, 3 Drawing Sheets

MITTEN PACIFIER

CROSS-REFERENCE TO RELATED APPLICATIONS

This application claims priority to Provisional Application U.S. Ser. No. 62/797,991, filed on Jan. 29, 2019, which is herein incorporated by reference in its entirety.

FIELD OF THE INVENTION

The invention relates to infant and baby pacifiers.

BACKGROUND OF THE INVENTION

Babies have a natural inclination to place their hands next to their mouth, often sucking their thumb. Parents and other caregivers commonly use a pacifier as a substitute for this rooting or sucking instinct. Many babies quickly adapt to the pacifier which can soothe the baby, stop crying, and make going to sleep easier. However, it is not unusual for the baby to lose the pacifier, while asleep or awake. Small babies are unable to find and replace the pacifier in his/her mouth, leading to crying, stress and unhappiness. Parents or other caretakers then must search for the pacifier, often in a dark room, which complicates the search. At other times, the parent/caretaker cannot reach the dropped pacifier, such as when the baby is in a car seat in the back seat of a vehicle and the parent is driving.

Various devices have been designed to minimize or eliminate problems with conventional pacifiers, including mitten pacifiers. For example, U.S. Pat. No. 9,560,888 in the name of Kiraly shows a conventional pacifier strapped to the back portion of a mitten. U.S. published application 2009/0163952 in the name of Kash utilizes a conventional pacifier extending through a hole in the fingertips or palm of the mitten. Neither of these mitten pacifiers are ideal, since the location of the pacifier is not adjacent the thumb, which is a more natural position than location on the fingertips or back of the hand.

Therefore, there is a need for an improved pacifier which overcomes the problems of the prior art.

A further objective of the present invention is the provision of a pacifier comprising of a nipple attached to the outside of a mitten and extending outwardly from the side of the mitten overlying the baby's thumb.

Another objective of the present invention the provision of a pacifier which can be placed on the baby's hand as a self-contained unit so as to preclude the pacifier from becoming lost or non-usable.

A further objective of the present invention is the provision of a pacifier which simulates a baby's natural tendency to suck their thumb.

Still another objective of the present invention is the provision of a mitten pacifier which is non-handed for use on either the left or right hand of a baby.

Yet another objective of the present invention is the provision of a mitten pacifier which is easy to place on the baby's hand.

Yet another objective of the present invention is the provision of a pacifier that can be used by a baby when awake and asleep.

Another objective of the present invention is the provision of a mitten pacifier which is economical to manufacture and safe to use.

These and other objectives will become apparent from the following description of the invention.

SUMMARY OF THE INVENTION

A pacifier is provided with the mitten for wearing on either hand of a baby and a nipple permanently attached to the mitten. The nipple is oriented so as to extend outwardly from the mitten on a side adjacent the baby's thumb. The nipple extends substantially perpendicular to the baby's fingers when the hand is open, and substantially parallel to the plane formed by the palm of the mitten. There are no internal obstructions within the mitten. The mitten includes a strap which can be fastened to secure the mitten on the baby's left or right hand.

DETAILED DESCRIPTION OF THE INVENTION

Figure 1:
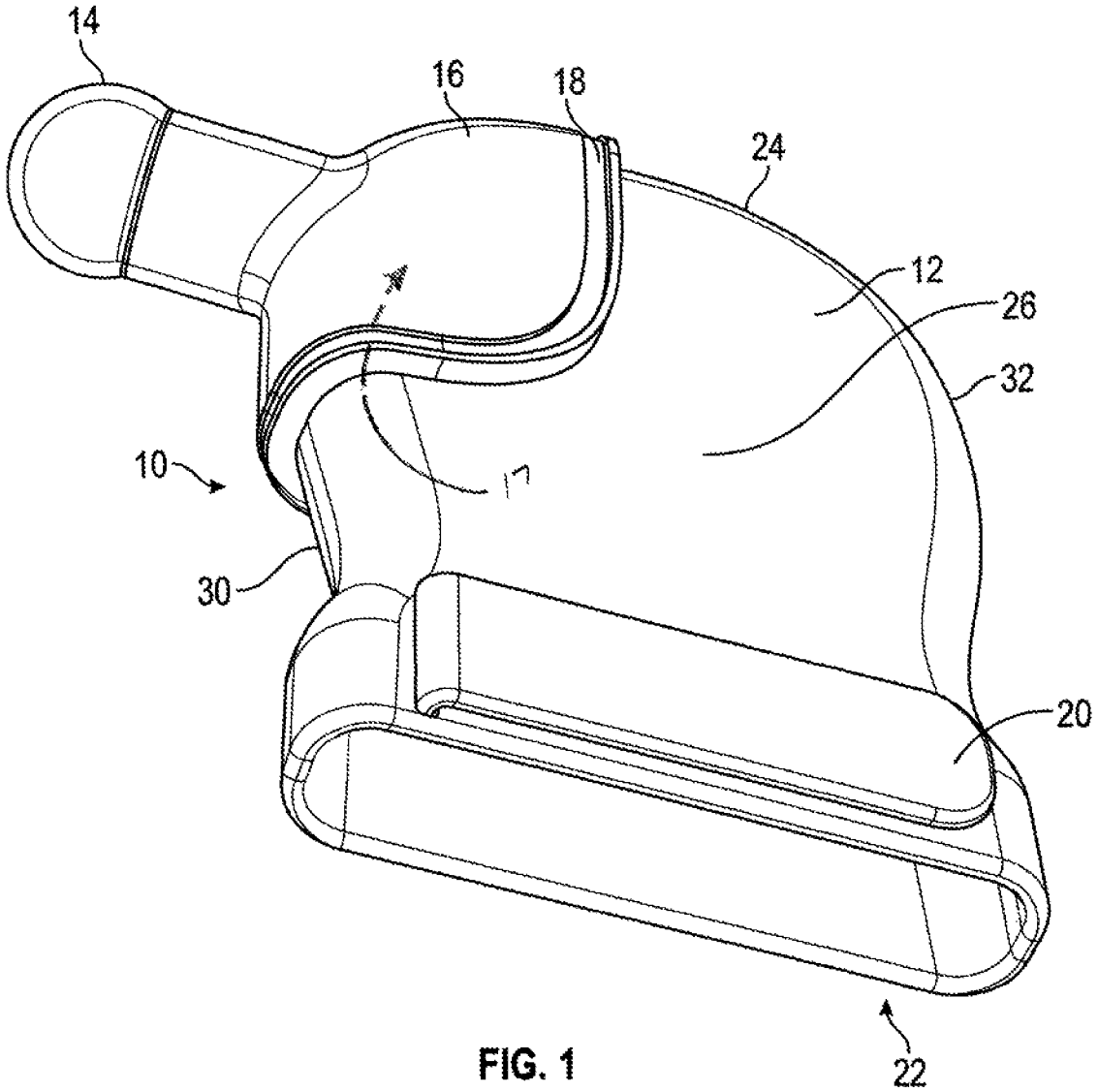
FIG. 1 is a perspective view of the mitten pacifier of the present invention, showing the back side of the mitten for use of the pacifier on the right hand of a baby, or alternatively the front side of the mitten for use on the left hand of a baby.
Figure 2:
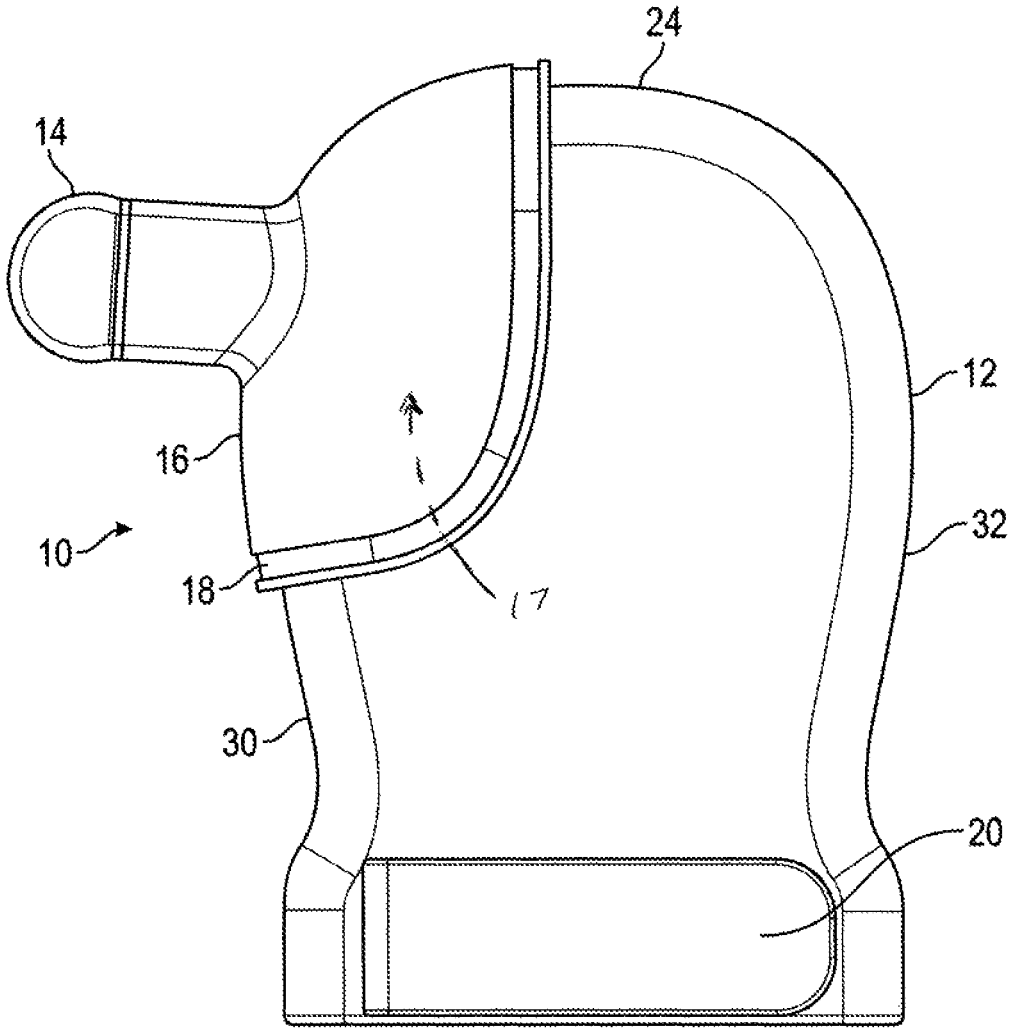
FIG. 2 is a back/front elevation view of the mitten pacifier view of the mitten pacifier.
Figure 3:
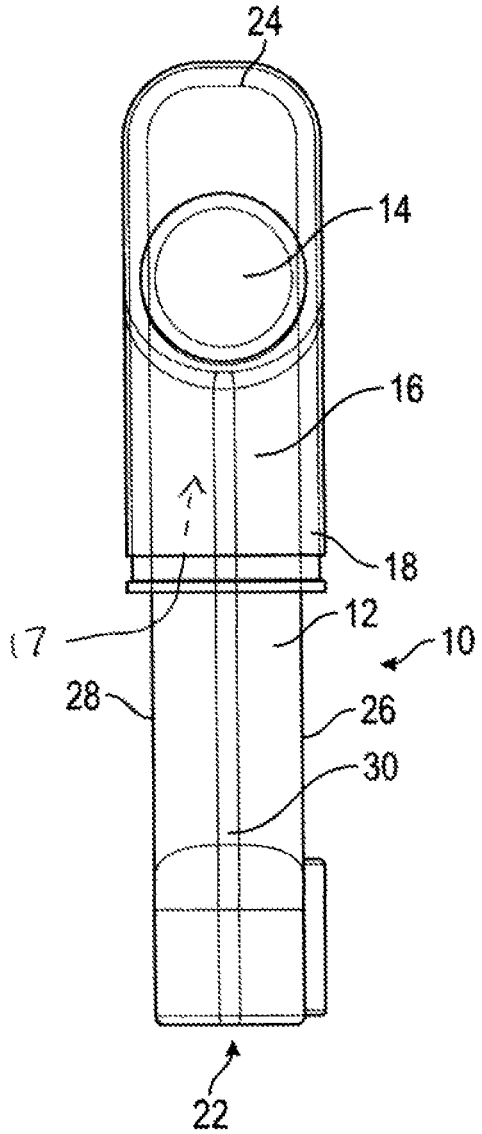
FIG. 3 is a side elevation view of the mitten pacifier.
Figure 4:
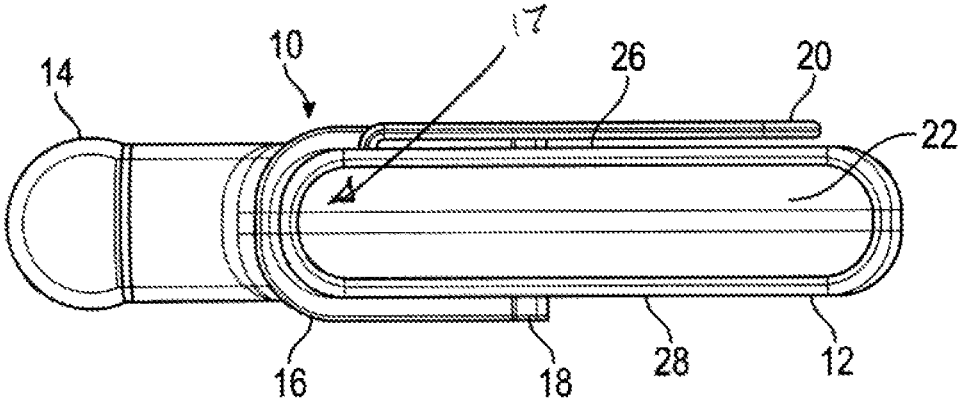
FIG. 4 is a bottom view of the mitten pacifier.

The mitten pacifier of the present invention is generally designated by the reference numeral 10 in the drawings. The pacifier 10 generally includes a mitten 12 with a nipple 14 on the outside of the mitten. The nipple 14 includes an enlarged diameter base 16 attached to the mitten 12 in any convenient manner, such as stitching extending along the perimeter edge 18, or otherwise adhered or fastened to the outside of the mitten 12. For example, the base 16 may include a pocket 17 to fit over the upper corner of the mitten, as seen in the drawings. A strap 20 is provided adjacent the open lower end 22 and preferably includes Velcro material for securing the strap around the baby's wrist to maintain the pacifier mitten 10 on the baby's hand. The strap 20 may include a snap fastener, a buckle, a button, or other fastening means. The strap 20 may extend through a ring (not shown) attached to the mitten 12, to allow the strap to be tightened and loosened.

The nipple 14 is oriented on the mitten 12 in a position corresponding to the baby's thumb. More particularly, the mitten includes an open wrist end 22, a closed finger end 24 opposite the open wrist end 22, a back portion 26, a front or palm portion 28, and opposite sides 30, 32. The sides 30, 32 correspond to the thumb area of the baby's hand and to the area of the baby's little finger. The pacifier mitten 10 is non-handed, meaning that it can be worn on either the left or right hand of the baby. The front and back portion of the mitten 12 are reversed, depending upon which hand the pacifier 10 is worn on. The pacifier 10 is simply rotated 180° about its longitudinal axis for use on the left or right hand. The strap 20 will be wrapped around the top or bottom of the baby's wrist, depending on whether the mitten 12 is placed on the right or left hand.

The nipple 14 extends substantially parallel to a plane of the palm of the baby's hand, when the hand is open, i.e., parallel to the palm side or back side of the mitten 12, and extends substantially perpendicular to the direction of extended fingers of the baby. Thus, the laterally extending nipple 14 is aligned with, or overlies, the baby's thumb on inside lateral edge of the hand (when the palm is facing downwardly or forwardly), which permits the baby to easily find the nipple due to their natural rooting instincts In use, a parent or caregiver can quickly and easily place the pacifier mitten 10 over either hand of the baby, with the nipple 14 overlying the baby's thumb, and then secure the mitten on the hand using the strap 20. The baby can easily locate and place the nipple in their mouth, or the parent/caregiver can assist the baby to place the nipple in their mouth. The pacifier 10 helps deter a baby from sucking his/her thumb. The pacifier 10 can be worn while the infant or baby is asleep or awake, will remain on the hand, and will not become lost if the pacifier falls out or is spit out of the baby's mouth.

The mitten 12 may be made of material which will not irritate the skin on a baby's hand or face. The mitten 12 may also be made of a stretch material. As an alternative to the strap 20, the mitten 12 may include elastic adjacent the open wrist end 22.

The enlarged base 16 of the nipple 14 may minimize and decrease the amount of saliva and spit-up which contacts or is absorbed by the fabric of the mitten 12. The mitten size and nipple size may vary, depending on the age and size of the baby.

The pacifier mitten 10 can soothe the baby, deter thumb sucking, and promote better sleep. The pacifier mitten 10 allows the baby to self-soothe, since the pacifier will not become lost. Thus, the baby will cry less, since he/she is able to locate and use the pacifier and allow the baby to fall asleep or put himself/herself back to sleep more easily. The pacifier mitten 10 also eliminates a search in the dark for a pacifier that may be lost in the crib or on the floor, since the mitten 12 is secured to the baby's wrist. The secured pacifier 10 also prevents dropping when the baby is in a car seat or other environment where the parent cannot easily or readily reach the baby.

The pacifier 10 allows for a natural motion by a baby to place their thumb-side of their hand to their mouth to receive the nipple 14, rather than a more awkward orientation of the fingertips to the mouth. The pacifier 10 also reduces parent and caregiver intervention to find a pacifier. The location of the nipple 14 also solicits the natural rooting reflex, which leaves the baby to easily locate the nipple for sucking. The interior of the mitten 12 is hollow or open, which allows free movement of the fingers and thumb within the mitten 12 without obstruction by other interior objects. The nipple location on the mitten also encourages self-containment of the baby's arms, thereby increasing the sense of security and peacefulness for the baby. The location of the nipple also allows the parent or caretaker to choose which hand the mitten is placed on, therefore encouraging hand dominance or ambidexterity. The pacifier mitten 10 also promotes longer periods of rest for the baby, with the natural reflex to root or suck on their thumb, since the nipple is located in a position simulating the thumb. Thus, the baby to can self-soothe before fully awakening and crying.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed:

1. A pacifier, comprising:

a mitten adapted to fit over a baby's hand and having a palm, a back opposite the palm, and opposite left and right side edges;

a nipple attached to one of the side edges of the mitten so as to extend laterally outwardly to the left or to the right from the one side edge, and adapted to be adjacent a thumb of the baby's hand when the mitten is worn; and a base surrounding the nipple and having spaced apart, parallel front and back sides to receive the mitten therebetween so as to cover portions of the palm and back of the mitten;

the nipple having a bulbous tip and a reduced diameter neck extending from the bulbous tip to the base, so that the bulbous tip is adapted to be enclosed in the baby's mouth when the baby sucks on the nipple; and the neck having a curved radius adjacent the base; and wherein there are no internal obstructions within the mitten.

2. The pacifier of claim 1 further comprising a fastener on the mitten to releasably secure the mitten around the baby's wrist.

3. The pacifier of claim 1 wherein the mitten is non-handed.

4. The pacifier of claim 1 wherein the nipple is permanently connected to the mitten.

5. The pacifier of claim 1 wherein the palm and back define substantially parallel planes and the nipple extends in a direction parallel to the planes.

6. The pacifier of claim 1 wherein the neck defines nipple a longitudinal axis for the nipple, and the mitten has a longitudinal axis extending from an open wrist end to a closed finger end, and the longitudinal axes of the nipple and the mitten being substantially perpendicular to one another.

7. A pacifier, comprising:

a mitten having an open wrist end, a closed finger end, and opposite lateral sides between the wrist and finger ends;

a suckling nipple extending laterally outwardly from only one of the lateral sides of the mitten;

the mitten having a palm portion and a back portion, and the suckling nipple extending from a juncture of the palm and back portions at the one lateral side; and a base extending 360 degrees around the nipple and having palm and back panels extending from the suckling nipple and having a pocket between the palm and back panels to receive the palm and back portions of the mitten, respectively;

the nipple having a bulbous tip on top of a narrowed neck, and the neck connecting to the base;

the bulbous tip, the neck, and the base having an integral construction; and wherein there are no internal obstructions within the mitten.

8. The pacifier of claim 7 wherein the nipple extends in a direction parallel to the back portion.

9. The pacifier of claim 7 wherein the nipple has a longitudinal axis between top and bottom ends and the mitten has a longitudinal axis between the wrist and finger ends, and the longitudinal axes being substantially perpendicular to one another.

10. The pacifier of claim 7 further comprising means for securing the mitten on a baby's hand.

11. The pacifier of claim 7 wherein the mitten is adapted to fit on left and right hands.

12. The pacifier of claim 7 wherein the base extends from approximately a 12 o'clock position at a top of the mitten when the mitten is in a vertical orientation to approximately 90 degrees towards only one side edge of the mitten.

13. A pacifier, comprising:

a non-handed mitten adapted to be secured on either hand of a baby;

a nipple with an enlarged base permanently attached to the mitten, an outer tip opposite the base and being round in cross section, and a neck connecting the tip and the base, with the neck having a smaller diameter that the tip;

the base extending 360 degrees around the nipple and extending from approximately 12 o'clock along a 90 degree arc in only one direction on the mitten, and covering portions on front and back surfaces of the mitten; and the nipple adapted to extend laterally from adjacent a thumb of the baby's hand, wherein there are no internal obstructions within the mitten.

14. The pacifier of claim 13 wherein the nipple is adapted to extend substantially parallel to a plane of the palm of the baby's hand, when the hand is open.

15. The pacifier of claim 13 wherein the nipple is adapted to extend substantially perpendicular to extended fingers of the baby.

16. The pacifier of claim 13 further comprising a strap adjacent a bottom opening of the mitten adapted to secure the mitten on the baby's hand.

17. The pacifier of claim 13 wherein the neck has a curved radius adjacent the base.

* * * * *